United States Patent [19]

Fromson et al.

[11] Patent Number: 4,865,699

[45] Date of Patent: Sep. 12, 1989

[54] PROCESS AND APPARATUS FOR ANODIZING ALUMINUM

[76] Inventors: Howard A. Fromson, 15 Rogues Ridge Rd., Weston, Conn. 06880; Robert F. Gracia, P.O. Box 104, Old Turnpike Rd., Woodstock, Conn. 06282

[21] Appl. No.: 211,425

[22] Filed: Jun. 24, 1988

[51] Int. Cl.[4] ..... C25D 11/04

[52] U.S. Cl. ..... 204/28; 204/207

[58] Field of Search ..... 204/28, 206, 207

[56] References Cited

U.S. PATENT DOCUMENTS 3,865,700 2/1975 Fromson ..... 204/28

*Primary Examiner*—T. M. Tufariello

*Attorney, Agent, or Firm*—Felfe & Lynch

[57] ABSTRACT

Anodizing current is prevented from being carried downstream by an aluminum web after anodizing in a continuous anodizing process. An anode is placed in a post-treatment cell containing an electrolyte which is electrically connected to a cathode in the anodizing cell via a source of DC current which is independent of the source of anodizing current. The web polarity is switched from positive to negative and a voltage greater than the exist voltage of the web is applied to prevent anodizing current from being carried downstream in the web after anodizing.

11 Claims, 1 Drawing Sheet

PROCESS AND APPARATUS FOR ANODIZING ALUMINUM

BACKGROUND

This invention relates to process and apparatus for continuously anodizing aluminum. The term aluminum is used herein to include aluminum base alloys which, like pure aluminum, can be electrolytically anodized to form oxide coatings. More particularly, this invention relates to a technique for continuously anodizing coils or lengths of aluminum, such as aluminum sheets, strips, wire, rods, shapes and the like (hereinafter collectively referred to as aluminum web).

Aluminum in sheet, strip and wire form has been continuously anodized by a number of techniques for many years. See, for example, U.S. Pat. Nos. 3,865,700, issued Feb. 11, 1975 and Re. 29,754, reissue Sept. 5, 1978. Such anodized products used for electrical and decorative purposes, in the manufacture of household appliances, automotive trim, building materials, farm equipment, furniture, sporting goods, cans, container closures, lithographic plates, transformers, and in many other market and product areas.

Because anodizing forms an aluminum oxide coating which is a dielectric, current introduced into the web for anodizing is carried in the web after anodizing. This is manifested by undesirable arcing when the edges of the web contact the sides of subsequent treatment tanks or the coil is sheared.

SUMMARY

The present invention overcomes these problems by preventing anodizing current from being carried downstream in the web after anodizing.

The present invention provides improved process and apparatus wherein the anodized web is made negative after anodizing at a voltage greater than the exit voltage of the web being anodized.

In a preferred embodiment, the invention is carried out by placing an anode in a post-treatment cell containing an electrolyte which is electrically connected to a cathode in the anodizing cell via a source of DC current which is independent of the source of anodizing current. The web polarity is switched from positive to negative and a voltage greater than the exit voltage of the web is applied to prevent anodizing current from being carried downstream in the web after anodizing.

The aluminum web can be cleaned and pretreated before anodizing by procedures and methods known in the art. Graining by mechanical, chemical or electrochemical means is commonly practiced. Brush graining according to U.S. Pat. No. 4,183,788 issued Jan. 15, 1980 is preferred.

The anodized aluminum can be post-treated after anodizing by any known method depending on the intended use for the anodized aluminum. Anodized aluminum is commonly post-treated by sealing in hot water or a solution of nickel acetate. Other chemical treatments can also be used. It is preferred to use a post-treatment which provides an electrolyte as described herein. The post-treatment with sodium silicate as described in U.S. Pat. No. 3,181,461 issued May 4, 1965 is preferred where the anodized aluminum is intended for use as lithographic printing plates.

DESCRIPTION OF THE DRAWING

The present invention will be more fully understood from the following description taken in conjunction with the accompanying drawing wherein.

Figure 1:
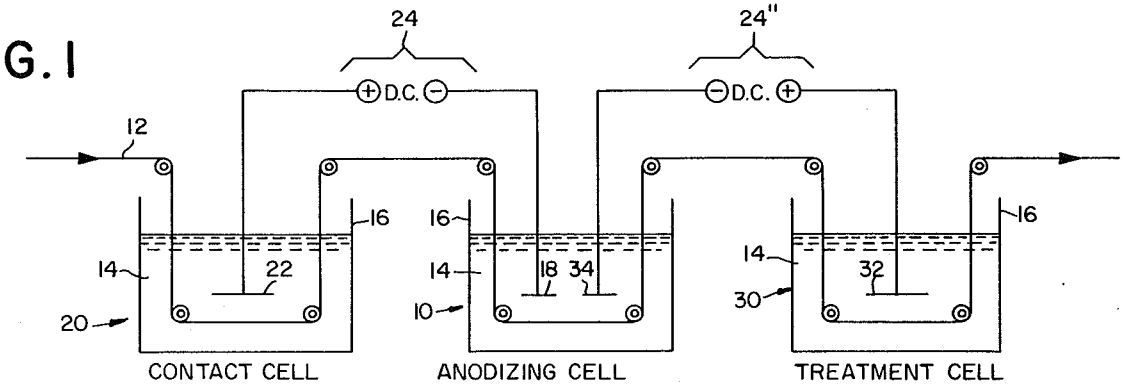
FIG. 1 is a schematic flow diagram illustrating the features of the invention in its most basic form.

Referring now to the drawing and in particular to FIG. 1, the process and apparatus for continuously anodizing aluminum web 12 includes an anodizing cell indicated generally by reference numeral 10 preceded by a contact cell indicated generally by reference numeral 20. Each cell includes a suitable cell member 16 for containing an electrolyte 14. The anodizing cell 10 has a cathode 18 therein connected to a source of direct current 24. The aluminum web 12 continually passes through the contact cell 20 followed by the anodizing cell 10 with the aid of conventional guide rollers positioned as shown in FIG. 1.

The anodizing direct current is introduced into the web 12 in the contact cell 20.

Treatment cell 30 also having a cell 16 and electrolyte 14 follows anodizing cell 10. In order to anodize throughout the cell 10, the web 12 must carry at least sufficient voltage to form a barrier layer. The formation of the anodic barrier layer in sulfuric acid is normally 12–14 volts and because the web is positive (anodic) voltage s as the web exits the cell 10. The web now has an anodic oxide coating which prevents the current from going to ground unless the oxide is removed and metal to metal contact is made. This occurs in prior processes quite frequently if the web contacts the side of rinse or treatment tanks downstream of the anodizing cell. Severe arcing occurs causing pin holes or pock marks in the walls of the metal tanks. The excess voltage can also go to ground when the web is cut. Severe arcing also occurs in this instance to the point of melting steel shear blade edges.

To deal with this problem, the invention switches the charge of the web after it leaves the anodizing cell (from positive to negative) and draws off the excess voltage that remains in the web. This is accomplished by providing a source of DC current 24'' independent of the source of anodizing current connected to an anode 32 in the treatment cell 30 and a cathode 34 in the anodizing cell 10. In order to prevent current from flowing in the web 12, the voltage applied by source 24'' should exceed the excess voltage in the web 12 as it exits cell 10.

Figure 2:
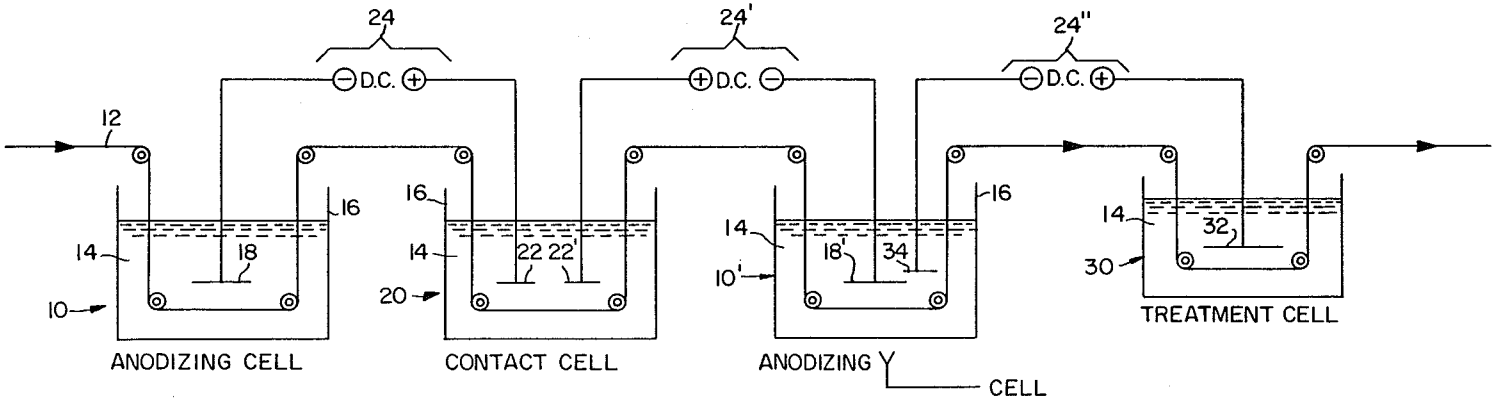
FIG. 2 is a schematic flow diagram illustrating a preferred embodiment of apparatus for carrying out the process of the invention in a preferred manner.

FIG. 2 illustrates preferred embodiment according to U.S. Pat. No. Re. 19,754 wherein the cells 10 and 20 are reversed and a second anodizing cell 20 follows the contact cell 20. The second cell 10' contains a cathode 18' which is connected to a second source of direct current 24'. The contact cell 20 contains a second anode 22' which is connected to the same second source of direct current 24'. By utilizing the preferred embodiment with a contact cell 20 between two anodizing cells 10 and 10', the anodizing current introduced into the contact cell 20 from the two separate sources of direct current 24 and 24', travels in both directions thus effectively doubling the current carrying capacity of the moving aluminum web 12. Stated differently, anodizing current is introduced into the web 12 in contact cell 20 from current source 24 which flows in a direction opposite to the direction of movement of the web 12 into the preceding anodizing cell 10 wherein a portion of the desired anodized porous oxide coating is formed. The anodizing operation is completed in anodizing cell 10' by anodizing current from source 24' picked up by the web 12 and contact cell 20 which is transmitted there along to the anodizing cell 10'. The web 12 exits from anodizing cell 10' with the desired thickness of porous oxide coating formed thereon.

In FIG. 2 the charge of the web is switched from positive to negative and excess voltage is drawn off in the same manner as described for FIG. 1.

EXAMPLE

Three stainless steel electrodes were placed in an insulated silicating cell containing 3% sodium silicate at a pH of 11.7—Philadelphia Quartz Start Brand. The electrodes were immersed approximately 12 inches in the solution approximately 6 inches from the moving aluminum web. The electrodes were attached as anodes 32 to a rectifier 24" as shown in FIG. 2. Three cathodes 34 in the cell 10' were also attached to the same rectifier 24".

A coil of 1100 alloy aluminum was run on a continuous web line as shown in FIG. 2 with a brush graining operation before the cell 10, a rinse stand before and after cell 30 and conventional handling and feeding equipment. The web was grained using calcined alumina in accordance with U.S. Pat. No. 4,183,788, anodized in 20% sulfuric acid at 95 degrees F. using the contact cell configuration shown in FIG. 2. The charge of the web switched form positive to negative in cell 30 by applying 1700 amps of current at a tank voltage of 43 volts via rectifier 24". The finished coil was cut into sheets and coated with diazo resin. The coated product was then exposed through a negative developed with a standard additive developer such as Western's Black Diamond and placed on a Goss Metro newspaper press. The total run length was 85,000 impressions. No toning or scumming problems were experienced.

What is claimed:

1. In a process for the continuous coil anodizing of an aluminum web, the improvement for preventing the flow of current after anodizing which comprises making the anodized web negative after anodizing at a voltage greater than the exit voltage of the web being anodized by passing said web through a treatment cell containing an electrolyte and a positive electrode electrically tied to a negative electrode in an anodizing cell via a source of DC current independent of the source of anodizing current, said greater voltage being applied in said treatment cell by said independent source of current.

2. Process of claim 1 wherein the anodizing is carried out in aqueous sulfuric acid.

3. Process of claim 1 wherein the treatment cell electrolyte is a solution of sodium silicate.

4. Process of claim 1 wherein the treatment cell electrolyte is a solution of nickel acetate.

5. Process of claim 1 which includes the step of brush graining prior to anodizing.

6. In apparatus for the continuous coil anodizing of an aluminum web, the improvement for preventing the flow of current after anodizing which comprises means for making the anodized web negative after anodizing by applying a voltage greater than the exit voltage of the web being anodized including treatment cell means following anodizing cell means, said treatment cell means containing an electrolyte and positive electrode means connected to a negative electrode means in said anodizing cell means via DC current means independent of the source of anodizing current for applying said greater voltage.

7. Apparatus of claim 6 wherein the anodizing cell means contains aqueous sulfuric acid.

8. Apparatus of claim 6, wherein the treatment cell means electrolyte is a solution of sodium silicate.

9. Apparatus of claim 6 which further includes means for brush graining the web prior to anodizing.

10. Lithographic substrate made by the process of claim 3,

11. Lithographic substrate made by the process of claim 5.

* * * * *